US005894867A

United States Patent [19]

Ward et al.

[11] Patent Number: 5,894,867

[45] Date of Patent: Apr. 20, 1999

[54] PROCESS FOR PRODUCING PAPER USING PAPERMAKERS FORMING FABRIC

[75] Inventors: Kevin J. Ward, Nova Scotia, Canada; Robert G. Wilson, Wake Forest, N.C.

[73] Assignee: Weavexx Corporation, Wake Forest, N.C.

[21] Appl. No.: 08/958,025

[22] Filed: Oct. 27, 1997

Related U.S. Application Data

[60] Division of application No. 08/611,203, Mar. 5, 1996, Pat. No. 5,709,250, and a continuation-in-part of application No. 08/307,937, Sep. 16, 1994, Pat. No. 5,518,042.

[51] Int. Cl.[6] ..... D03D 13/00

[52] U.S. Cl. ..... 139/383 A; 139/425 A; 162/903

[58] Field of Search ..... 139/383 A, 425 A; 162/903

[56] References Cited

U.S. PATENT DOCUMENTS

| | | |
|---|---|---|
| Re. 33,195 | 4/1990 | McDonald et al. . |
| 4,093,512 | 6/1978 | Fleischer . |
| 4,182,381 | 1/1980 | Gisbourne . |
| 4,244,543 | 1/1981 | Ericson . |
| 4,289,173 | 9/1981 | Miller . |
| 4,452,284 | 6/1984 | Eckstein et al. . |

(List continued on next page.)

FOREIGN PATENT DOCUMENTS

| | | |
|---|---|---|
| 1115177 | 12/1981 | Canada . |
| 0 048 962 | 9/1981 | European Pat. Off. . |
| 0158 710 | 10/1984 | European Pat. Off. . |
| 0185 177 | 10/1985 | European Pat. Off. . |
| 0264 881 | 10/1987 | European Pat. Off. . |
| 0269 070 | 11/1987 | European Pat. Off. . |
| 0 284 575 | 2/1988 | European Pat. Off. . |
| 0 283 181 | 3/1988 | European Pat. Off. . |
| 0 350 673 | 6/1989 | European Pat. Off. . |
| 0 672 782 | 3/1995 | European Pat. Off. . |
| 2 597 123 | 10/1987 | France . |
| 33 29 740 | 3/1985 | Germany . |
| 2-277848 | 11/1990 | Japan . |
| 8-158285 | 6/1996 | Japan . |
| 9-6158285 | 6/1996 | Japan . |
| 9-41282 | 2/1997 | Japan . |
| 9-87990 | 3/1997 | Japan . |
| 22450060 | 2/1991 | United Kingdom . |
| WO 89/09848 | 4/1989 | WIPO . |
| WO 93/10304 | 5/1993 | WIPO . |

OTHER PUBLICATIONS

Warren, C.A., "The Importance of Yarn Properties in Wet–End Wire Construction," Seminar, The Theory of Water Removal, Dec. 12, 1979.

Rule 132 Declaration of Robert G. Wilson (Jun. 26, 1997).

Supplemental Declaration and Power of Attorney for Patent Application; (Jun. 6, 1997); Filed in U.S. Serial No.: 08/603,925; Filed Feb. 22, 1996.

*Primary Examiner*—Andy Falik

*Attorney, Agent, or Firm*—Myers, Bigel Sibley and Sajovec

[57] ABSTRACT

A process for forming paper using papermaker's forming fabric comprising a fabric layer including cross machine direction fabric yarns and machine direction fabric yarns interwoven to form a papermaking surface with alternating single knuckles thereon. First additional cross machine direction yarns are positioned between adjacent cross machine direction fabric yarns on the papermaking surface of the fabric layer. Second additional cross machine direction yarns are positioned between the cross machine direction fabric yarns on the papermaking surface of the fabric layer. Each of the first and second additional cross machine direction yarns serve as fiber supporting yarns and as locator yarns for another of the first and second additional cross machine direction yarns. Each of the first and second additional cross machine direction yarns are interwoven with the fabric layer to float over odd numbers of adjacent fabric layer machine direction yarns. The process includes depositing paper stock on the fabric to form a wet paper web, and removing moisture from the wet paper web to form the paper.

8 Claims, 6 Drawing Sheets

U.S. PATENT DOCUMENTS 4,453,573 6/1984 Thompson .
4,501,303 2/1985 Osterberg .
4,515,853 5/1985 Borel .
4,529,013 7/1985 Miller .
4,564,052 1/1986 Borel .
4,592,395 6/1986 Borel .
4,605,585 8/1986 Johansson .
4,611,639 9/1986 Bugge .
4,633,596 1/1987 Josef .
4,636,426 1/1987 Fleischer .
4,642,261 2/1987 Fearnhead .
4,676,278 6/1987 Dutt .
4,709,732 12/1987 Kinnunen .
4,729,412 3/1988 Bugge .
4,731,281 3/1988 Fleischer et al. .
4,739,803 4/1988 Borel .
4,759,975 7/1988 Sutherland .
4,909,284 3/1990 Kositzke .
4,934,414 6/1990 Borel .
4,941,514 7/1990 Taipale .
4,942,077 7/1990 Wendt et al. .
4,945,952 8/1990 Vohringer .
4,967,805 11/1990 Chiu et al. .
4,987,929 1/1991 Wilson ..... 139/383 A
4,989,647 2/1991 Marchand .
4,989,648 2/1991 Tate et al. .
4,998,568 3/1991 Vohringer .
5,074,339 12/1991 Vohringer .
5,084,326 1/1992 Vohringer .
5,092,372 3/1992 Fitzka et al. .
5,101,866 4/1992 Quigley .
5,116,478 5/1992 Tate et al. .
5,219,004 6/1993 Chiu .
5,228,482 7/1993 Fleischer .
5,358,014 10/1994 Kovar .
5,421,374 6/1995 Wright .
5,454,405 10/1995 Hawes .
5,482,567 1/1996 Barreto .
5,487,414 1/1996 Kuji et al. .
5,518,042 5/1996 Wilson ..... 139/383 A
5,520,225 5/1996 Quigley .
5,564,475 10/1996 Wright .
5,641,001 6/1997 Wilson .
5,709,250 1/1998 Ward et al. ..... 139/383 A
5,746,257 5/1998 Fry .

PROCESS FOR PRODUCING PAPER USING PAPERMAKERS FORMING FABRIC

CROSS REFERENCE TO RELATED APPLICATIONS

This is a divisional of U.S. patent application Ser. No. 08/611,203, filed Mar. 5, 1996, now U.S. Pat. No. 5,709,250 a continuation-in-part of U.S. patent application Ser. No. 08/307,937, filed on Sep. 16, 1994, now U.S. Pat No. 5,518,042.

FIELD OF THE INVENTION

This invention relates to woven fabrics and especially to paper forming fabrics.

DESCRIPTION OF THE PRIOR ART

In the conventional fourdrinier papermaking process, a water slurry, or suspension, of cellulosic fibers, known as the paper "stock", is fed onto the top of the upper run of a traveling endless belt of woven wire and/or synthetic material. The belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through the mesh openings of the belt, known as drainage holes, by vacuum means, or the like, located on the machine side of the belt, or "fabric". After leaving the forming section, the paper web is transferred to a press section of the machine, where it is passed through a series of pressure nips formed by cooperating press rolls to remove still more of the moisture content. The paper is then transferred to a dryer section for further moisture removal.

Such papermakers' fabrics are manufactured in accordance with two basic methods to form an endless belt. They are flat woven by a flat weaving process with their ends joined by any one of a number of well known methods to form an endless belt. Alternatively, they are woven directly in the form of a continuous belt by means of an endless weaving process. In a flat woven papermakers' fabric, the warp yarns extend in the machine direction and the filling yarns extend in the cross machine direction. In a papermakers' fabric having been woven in an endless fashion, the warp yarns extend in the cross machine direction and the filling yarns extend in the machine direction. As used herein the terms "machine direction" and "cross machine direction" refer, respectively, to a direction equivalent to the direction of travel of the papermakers' fabric on the papermaking machine, and a direction traverse to the direction of travel. Both methods are well known in the art and the term "endless belt" as used herein refers to belts made by either method.

Effective sheet support and lack of wire marking are important considerations in papermaking, especially for the forming section of the papermaking machine where the wet web is formed. The problem of wire marking is particularly acute in the formation of fine paper grades where the smoothness of the sheet side surface of the forming fabric is critical. Marking affects a host of paper properties, such as sheet mark, porosity, see through, pin holing, and the like. Accordingly, paper grades intended for use in carbonizing, cigarettes, electrical condensers, quality printing, and like grades of fine paper, have heretofore been formed on very fine woven forming fabrics or fine wire mesh forming fabrics. In order to ensure good paper quality, the side of the papermakers' fabric which contacts the paper stock must provide high support for the stock, preferably in the cross machine direction, because paper fibers delivered from a headbox to the forming fabric are generally aligned in the machine direction more so than in the cross machine direction. Trapping these paper fibers on the top of the forming fabric during the drainage process is more effectively accomplished by providing a permeable structure with a co-planar surface which allows paper fibers to bridge the support grid of the fabric, rather than align with the support grid. By "co-planar" is meant that the upper extremities of all yarns defining the paper forming surface are at the same level, such that at that level there is presented a substantially "planar" surface.

Such forming fabrics, however, may often be delicate and lack stability in the machine and cross machine directions, leading to a short service life. Abrasive and adhesive wear caused by contact with the papermaking machine equipment constitutes a substantial problem. The side of the papermakers' fabric which contacts the paper machine equipment must be tough and durable. Such qualities, however, most often are not compatible with the good drainage and fiber supporting characteristics desired for the sheet side of a papermakers' fabric.

In order to meet both standards, two layers of fabric can be woven at once by utilizing threads of different size and/or count per inch and another thread to bind them together. This fabric is commonly called a double layer fabric. Alternatively, fabrics have been created using multiple layers to insure that the fabric has desirable papermaking qualities on the surface that faces the paper web and desirable wear resistance properties on the machine contacting surface. For example, papermakers' fabrics may be produced from two separate fabrics, one having the qualities desired for the paper contacting side and the other with the qualities desired for the machine contacting side, joined together by a third set of threads. This type fabric is commonly called a triple-layer fabric. Generally, these structures do not possess the high level of stretch resistance desired in a papermaking fabric. Furthermore, the yarn that binds the fabric together will often produce a sheet mark, often from the long machine direction floats. Accordingly, no known fabrics have achieved the qualities necessary to meet the competing standards to produce superior paper.

In U.S. Pat. No. 4,987,929, issued Jan. 29, 1991, in the name of Robert G. Wilson, there is provided an improved papermakers' fabric for use in a papermaking machine, including an initial fabric layer having single float machine direction knuckles on the paper contacting surface and into which are woven additional fiber supporting cross machine direction yarns, preferably of smaller diameter than the fabric layer yarns. The additional fiber supporting cross machine direction yarns are held in place centrally between adjacent fabric layer cross machine direction yarns by additional cross machine direction locator yarns, generally being of approximately the same diameter as the fiber supporting yarns. The papermakers' fabric of the '929 patent may be a single-layer, double-layer or triple-layer fabric, and is a very effective design.

The '929 patent, however, includes separate locator and fiber supporting additional cross machine direction yarns, i.e. one of the additional cross machine direction yarns acts as a fiber supporting yarn which is located centrally between adjacent base fabric cross machine direction yarns by the other of the additional cross machine direction yarns. In this construction, the fiber supporting yarn preferably descends under only one base fabric machine direction yarn in a repeat. At the point where the fiber supporting yarn descends into the base fabric, it is located centrally by a single float locator yarn.

The top surface topography of the fabric according to the '929 patent is therefore, slightly non-uniform since the additional cross machine direction locator and fiber supporting yarns do not pass over equal numbers of adjacent base fabric layer machine direction yarns. This slight non-uniformity tends to result in wire marking on the paper sheet formed using the fabric.

In addition, in the weave according to the '929 patent only the additional cross machine direction locator yarns are used to stitch in multiple fabric layer constructions. Although the fabric of the '929 patent is very durable, it has been recognized that fabric life and internal fabric wear could be improved by increasing the number of stitch points.

Accordingly, there is a need for a paper forming fabric which provides the benefits of the fabric shown and described in the '929 patent but improves the fabric by reducing wire marking and improving fabric life through an increased number of stitch points.

SUMMARY OF THE INVENTION

It is, therefore, an object of the present invention to provide a papermakers' fabric with a superior fiber supporting surface, while maintaining a durable wear resistant machine contacting side of the fabric.

Another object of the present invention is to provide a papermakers' fabric in which a significant number of the paper fiber supporting yarns are fine and of a reduced diameter so that high quality support can be provided on the papermaking surface, yet the openness of the paper contacting surface remains high for effective drainage.

A further object of the present invention is to provide a papermakers' fabric having a predominance of cross machine direction support floats on the papermaking surface, with no machine direction yarn knuckle being greater than a single float.

Yet another object of the present invention is to provide a papermakers' fabric with excellent stability and wear resistance while not compromising the desirable papermaking characteristics of the sheet side of the fabric.

Still another object of the invention is to provide a process for forming high quality paper using a papermakers' fabric as herein described.

With the above and other objects in view, as will hereinafter appear, a feature of the present invention is the provision of a papermaker's forming fabric comprising a fabric layer including at least one set of cross machine direction yarns and at least one set of machine direction yarns interwoven to form a papermaking surface and a machine contacting surface with alternating single knuckles on the papermaking surface. First additional cross machine direction yarns are positioned between adjacent ones of the cross machine direction yarns on the papermaking surface of the fabric layer. Second additional cross machine direction yarns are positioned between adjacent ones of the cross machine direction yarns on the papermaking surface of the fabric layer. Each of the first and second additional cross machine direction yarns are fiber supporting yarns and each of the first and second additional cross machine direction yarns are locator yarns for another of the first and second additional cross machine direction yarns. The first and second additional cross machine direction yarns are interwoven with the fabric layer in opposite weave patterns.

The above and other features of the invention, including various novel details of construction and combinations of parts, will now be more particularly described with reference to the accompanying drawings and pointed out in the claims. It will be understood that the particular fabric embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawings in which is shown an illustrative embodiment of the invention, from which its novel features and advantages will be apparent. In the drawing.

DESCRIPTION OF THE PREFERRED EMBODIMENTS

Figure 1:
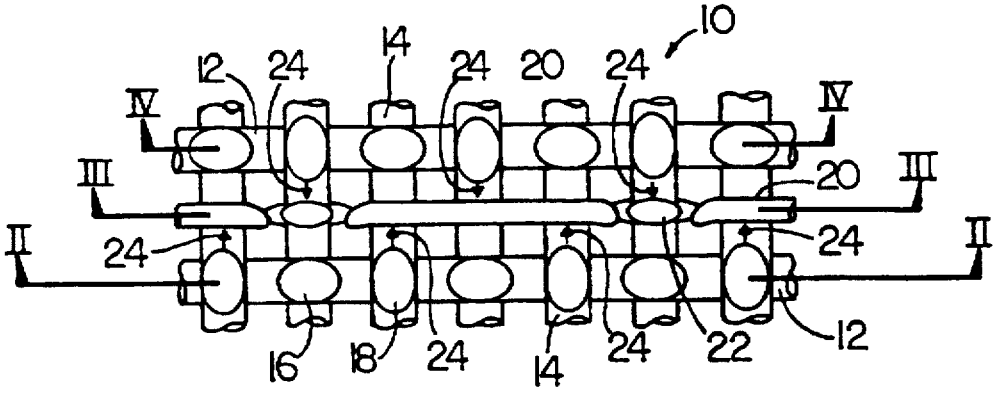
FIG. 1 PRIOR ART
FIG. 1 is a top plan view, in part diagrammatic, of a portion of a prior art papermaking fabric layer.
Figure 2:
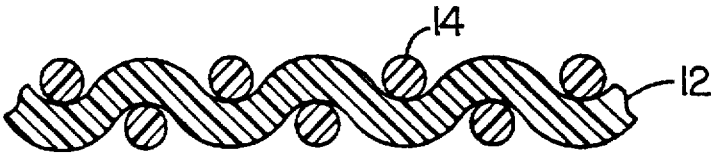
FIG. 2 PRIOR ART
FIG. 2 is a sectional view taken along line II—II of FIG. 1.
Figure 3:
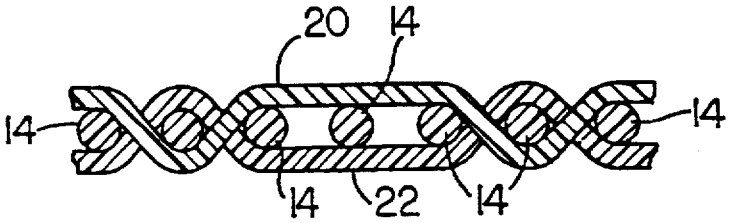
FIG. 3 PRIOR ART
FIG. 3 is a sectional view taken along line III—III of FIG. 1.
Figure 4:
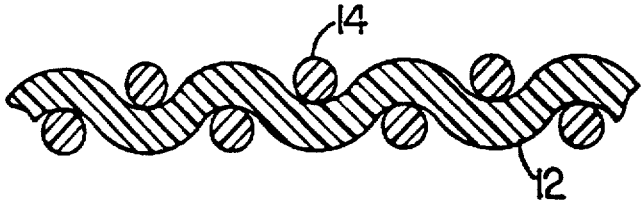
FIG. 4 PRIOR ART
FIG. 4 is a sectional view taken along line IV—IV of FIG. 1.

The fabric of the present invention will be described broadly, with a more detailed description following. This papermakers' fabric provides a superior papermaking surface and is especially suitable for the forming section of a papermaking machine. The fabric of the present invention is characterized by the presence of two additional yarns in the cross machine direction.

The fabric of the present invention is a papermakers' fabric with a particular weave. For ease of understanding the concepts of the invention, the fabric will be described as if a fabric layer were initially woven and then additional yarns added. Of course, the papermakers' fabric made according to the present invention will be woven in a one step weaving process, as is commonly done.

The yarns utilized in the fabric of the present invention will vary, depending upon the desired properties of the final papermakers' fabric. For example, the yarns may be multifilament yarns, monofilament yarns, twisted multifilament or monofilament yarns, spun yarns, or any combination thereof. It is within the skill of those practicing in the relevant art to select a yarn type, depending on the purpose of the desired fabric, to utilize the concepts of the present invention.

Yarns selected for use in the fabric of the present invention may be those commonly used in papermakers' fabric. The yarns may be cotton, wool, polypropylenes, polyesters, aramids, nylon, or the like. Again, one skilled in the relevant art will select a yarn material according to the particular application of the final fabric. A commonly used yarn which can be used to great advantage in weaving fabrics in accordance with the present invention is a polyester monofilament yarn, sold by Hoechst Celanese Fiber Industries under the trademark "Trevira".

Initially, there is provided a fabric layer structure. This layer may be a single layer fabric or a multiple layer fabric. The fabric must, however, have on its paper contacting surface single float machine direction knuckles. By single float machine direction knuckles is meant that no machine direction yarn ever passes over more than one consecutive cross machine direction yarn before passing back down into the center or bottom of the fabric layer. Instead of long machine direction yarn floats on the paper contacting surface of the fabric layer, knuckles are provided. In addition, the base structure fabric is provided with a series of alternating machine direction knuckles on two adjacent cross machine direction yarns of the fabric layer.

Interwoven with the fabric layer structure on its papermaking surface are two sets of additional cross machine direction yarns, first additional cross machine direction yarns and second additional cross machine direction yarns. In any location, only one of the first and second additional cross machine direction yarns serves as a fiber supporting yarn, while in yarn crossing locations both yarns serve as locator yarns. By "fiber supporting" is meant yarns adapted to support short-length paper slurry fibers during the paper forming process. By "locator" is meant yarns adapted to retain the fiber supporting yarns in proper position midway between fabric cross machine direction yarns. In a preferred embodiment of the fabric, the first and second additional cross machine direction yarns are of a smaller diameter than the yarns making up the base structure fabric. The size of the smaller diameter additional first cross machine direction yarns, and hence the second cross machine direction yarns as well, is governed by the size and spacing of the papermaking surface cross machine direction yarns of the base fabric. In the preferred triple layer embodiment of FIG. 12, the base fabric layer cross machine direction yarns may range from about 0.15 mm to 0.20 mm, and the additional cross machine direction yarns may range from about 0.09 mm to 0.17 mm. Generally, the diameter of the smaller yarns is about one half the diameter of the initial fabric layer cross machine direction yarns. Other suitable yarn diameters for the yarns of the base fabric structure and the corresponding first and second additional cross machine direction yarns are shown in the following table:

TABLE

| Papermaking surface cross machine direction yarns | | First and second additional cross machine direction yarns |
|---|---|---|
| Number/Inch | Dia. mm | Dia. mm |
| 50 | .22 | .104 |
| 45 | .22 | .105 |
| 40 | .22 | .106 |
| 35 | .22 | .107 |
| 30 | .22 | .108 |
| 40 | .23 | .101 |
| 40 | .24 | .115 |
| 40 | .25 | .120 |
| 40 | .26 | .124 |

The first and second additional yarns, serving as fiber supporting and locator cross machine direction yarns, are located generally between parallel cross machine direction yarns of the paper contacting surface of the initial fabric layer and are woven into this surface. The two additional cross machine direction yarns are woven into the papermaking surface of the initial (or base) fabric layer in generally reverse weave patterns, such that natural interposing forces cause the two yarns to align centrally between two adjacent initial fabric layer cross machine direction yarns. Each yarn of the interposing pair functions as an additional fiber supporting yarn and each yarn of the interposing pair acts as a locator yarn to position the fiber supporting yarn in the proper or ideal location on the papermaking surface.

The first and second additional cross machine direction yarns are woven into the paper contacting surface of the fabric layer in a weave pattern generally opposite to each other, creating end points. The end points of the additional first yarn and the additional second yarn is defined as the point where the two yarns cross each other and interchange positions. The present invention requires that these end points be located centrally between adjacent base weave cross machine direction yarns.

It should be noted that the series of alternating machine direction knuckles on the two adjacent cross machine direction yarns of the fabric layer act as lifter points for the additional fiber supporting yarns. Furthermore, one of the first and second additional yarns acts to centrally locate the other of the additional yarns between the two adjacent base weave cross machine direction yarns. The forces acting on the locator yarn are equal and opposite in direction to those acting on the fiber supporting yarns.

Referring to FIGS. 1–4, it will be seen that a prior art construction of a papermakers' forming fabric includes a single fabric layer 10 having cross machine direction yarns 12 interwoven with machine direction yarns 14. The intersections of the yarns 12, 14 create raised knob-like portions, or knuckles 16, illustrated in plan view (FIG. 1) diagrammatically by ovals 18. The long axis of each oval 18 indicates the direction of the upper-most yarn passing over the lower-most yarn, when viewed from above the uppermost level of the forming fabric.

The layer 10 is provided with additional fiber supporting cross machine direction yarns 20 and additional cross machine direction locator yarns 22. The fabric shown in FIGS. 1–4 is described in the aforesaid U.S. Pat. No. 4,987,929, and provides a fabric having relatively short floats (FIG. 3) of odd numbers on its papermaking surface, and providing less of a tendency to mark the paper formed, while providing effective drainage.

The additional fiber supporting yarns 20 serve to add support for the machine direction yarns 14 at a point at which support is needed, mid-way between neighboring cross machine direction yarns 12. Because of the small diameters of the fiber supporting yarns 20, space between the neighboring cross machine direction yarns 12 remains relatively open for appropriate drainage. Because the machine direction yarns 14 are angled either "up-hill" or "down-hill" relative to the fiber supporting yarns 20, the fiber supporting yarns, when left alone, tend to travel "down-hill", that is, from a knuckle in which the cross machine direction yarn is under a machine direction yarn toward the neighboring knuckle wherein a cross machine direction yarn is over the same machine direction yarn. See arrows 24 in FIG. 1, which connote "down-hill" slopes on machine direction yarns 14. The result of providing fiber supporting yarns without locator yarns is illustrated in the aforesaid '929 patent, in FIGS. 3, 12A and 12B. As depicted in those FIGS., the fiber supporting yarns tend to slide down hill toward a neighboring fabric cross machine direction yarn.

To prevent migration of the fiber supporting yarns 20 "down-hill", the locator yarns 22 are paired with the fiber supporting yarns 20 and operate to counteract the slope of the machine direction yarns 12, such that the fiber supporting yarns 20 are under no bias to migrate from their position mid way between the cross machine direction yarns 12. The natural forces of the hills and valleys of the machine direction yarns 14 work on the two smaller yarns with equal and opposite direction forces to centrally locate the additional fiber supporting yarns 20. Thus, the locator yarns 22 serve to retain the fiber supporting yarns 20 in their proper positions.

Figure 5:
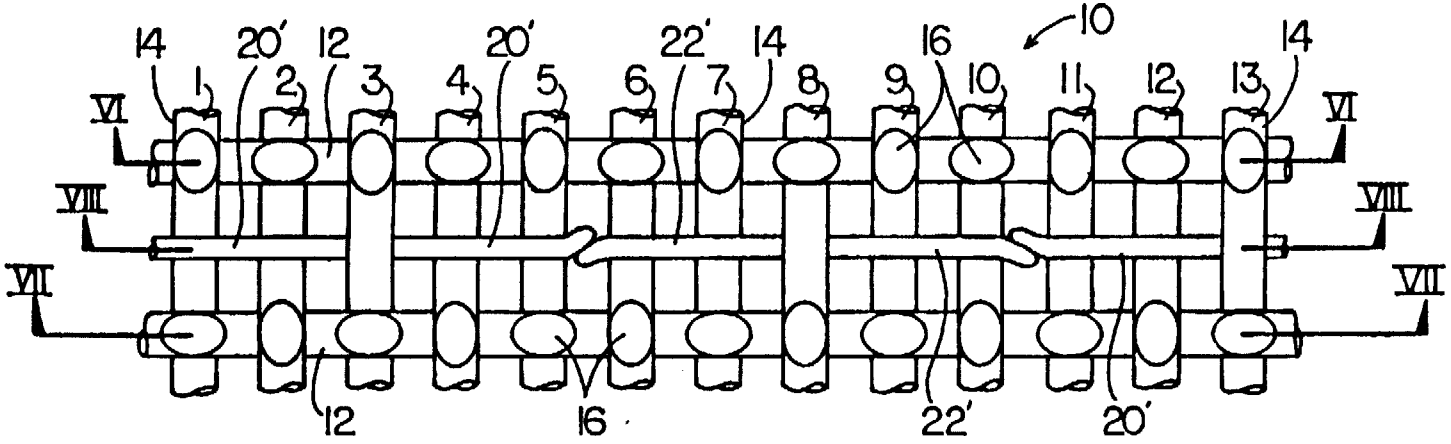
FIG. 5 is a top plan view, in part diagrammatic, of a portion of one form of a papermaking fabric layer illustrative of an embodiment of the invention.
Figure 6:
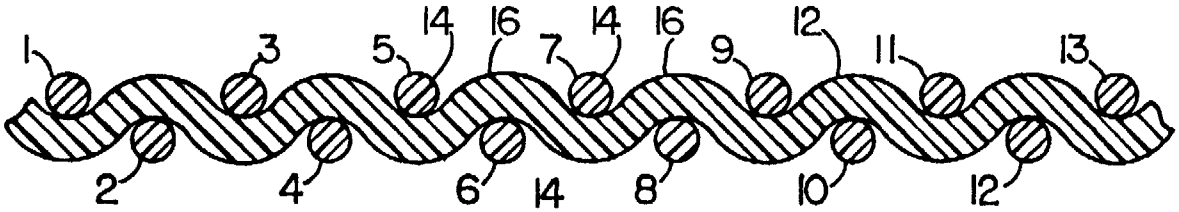
FIG. 6 is a sectional view taken along line VI—VI of FIG. 5.
Figure 7:
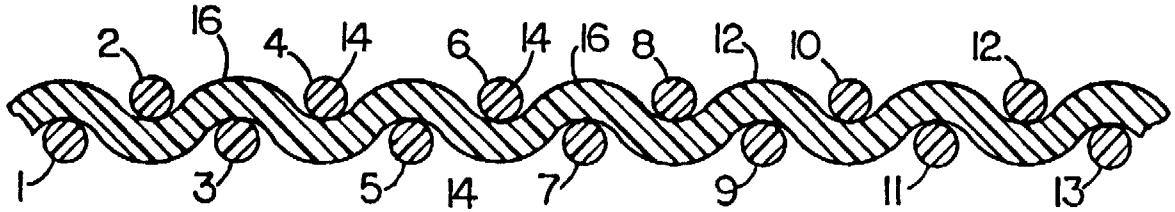
FIG. 7 is a sectional view taken along line VII—VII of FIG. 5.

Referring to FIGS. 5–7, it will be seen that in a first illustrative embodiment of the invention the fabric machine direction yarns 14 and cross machine direction yarns 12 are interwoven to provide single float knuckles 16 in both the machine direction and cross machine direction.

Woven into the layer 10 are first additional cross machine direction yarns 20' (FIGS. 5 and 8) positioned between adjacent cross machine direction yarns 12, and second additional cross machine direction yarns 22' positioned between adjacent cross machine direction yarns 12. Both additional yarns 20', 22' serve as fiber supporting yarns and both serve as locator yarns.

Figure 8:
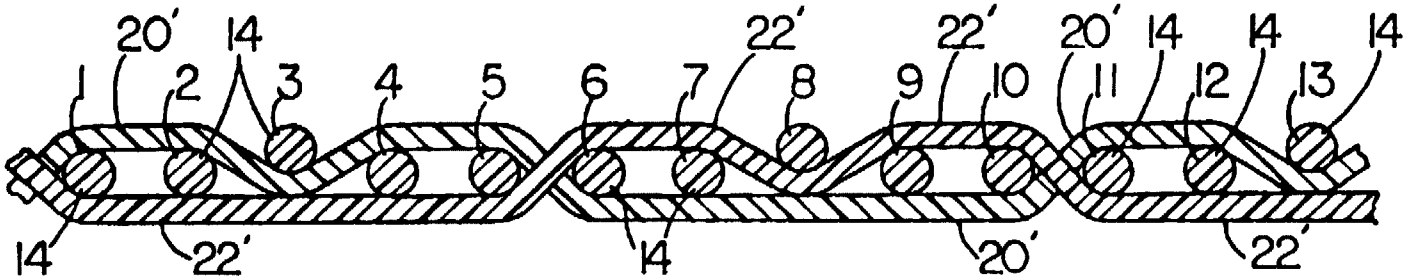
FIG. 8 is a sectional view taken along line VIII—VIII of FIG. 5.

In FIG. 8, there is shown a preferred weave pattern for the additional yarns 20' and 22'. For clarity and ease of comparison, the machine direction yarns 14 are designated 1–13 in FIGS. 5–8, and the machine direction yarns of an upper fabric layer 10' are similarly designated in FIG. 9. A second fabric layer 26 in FIG. 9 includes machine direction yarns 14' designated 30–42. As illustrated in FIGS. 5 and 8, each of the first additional yarns 20' extends over a float of two machine direction yarns 14, namely yarns numbered 1 and 2, under machine direction yarn number 3, over another float of two yarns, numbered 4 and 5, and under five yarns numbered 6–10. Second additional yarn 22' extends under the machine direction yarns numbered 1–5, over a float of two yarns numbered 6 and 7, under yarn number 8, and over another float of two yarns numbered 9 and 10. Thus, with respect to machine direction yarns 1 and 2, 4 and 5, and 11 and 12, the additional first yarns 20' serve as fiber supporting yarns. Similarly, with respect to machine direction yarns 6 and 7, and 9 and 10, the additional second yarns 22' serve as fiber supporting yarns. At the cross-over points, or "ends" of the first and second additional first and second cross machine direction yarns, as for example, between machine direction yarns 5 and 6, and 10 and 11, the first and second additional yarns each act as a locator yarn for the other.

Figure 9:
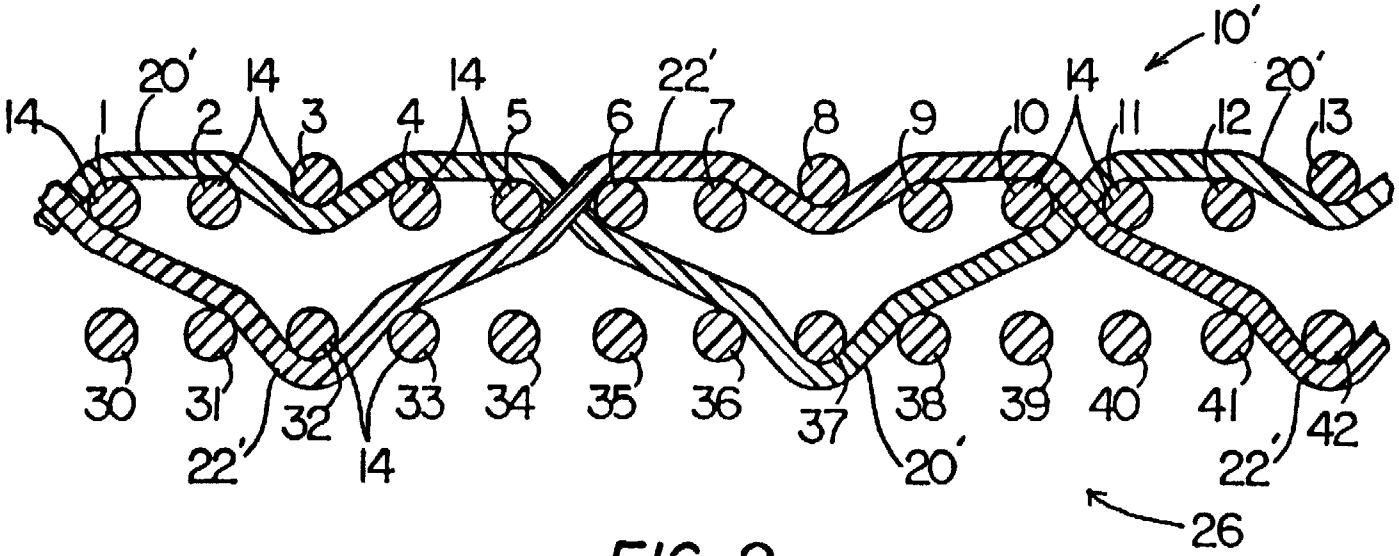
FIG. 9 is a sectional view similar to FIG. 8, but illustrative of another alternative embodiment of the invention.

Referring to FIG. 9, wherein there is illustrated a preferred weave pattern in a triple-layer embodiment, it will be seen that the first additional yarn 20' passes over a float of two machine direction yarns numbered 1 and 2, under a single machine direction yarn numbered 3, and over another float of two machine direction yarns numbered 4 and 5, from whence the yarn 20' passes beneath machine direction yarn numbered 6 and further passes beneath machine direction yarn 17 in the fabric layer 26. Additional yarn 20' emerges from beneath the top surface between machine direction yarns numbered 10 and 11, of the fabric layer 10'. The second additional yarn 22' follows a similar course, off-set from that of the first yarn 20'. Yarn 22' passes under machine direction yarn number 32 of the second fabric layer 26, passes between machine direction yarns numbered 5 and 6, over a float of two yarns numbered 6 and 7, under yarn numbered 8, thence over a float of two yarns numbered 9 and 10, and under yarn number 11 of the fabric layer 10' and yarn number 42 of the second fabric layer 26. Thus, in the embodiment shown in FIG. 9, each of the additional yarns 20', 22' serves three functions: (1) as a fiber supporting yarn, (2) as a locator yarn, and (3) as a binder of first and second fabric layers in a triple layer construction.

Figure 10:
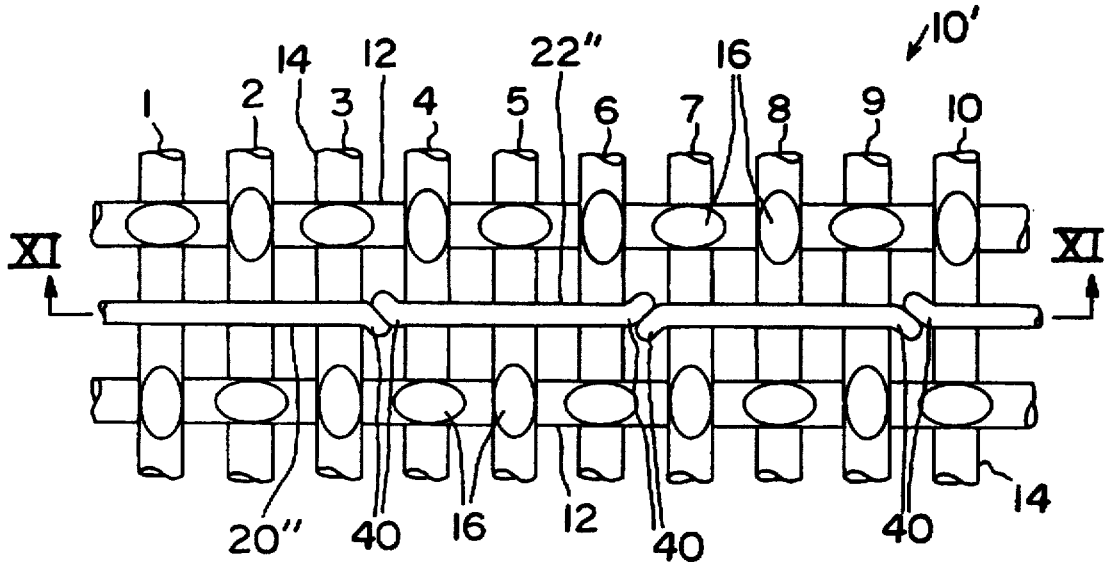
FIG. 10 is a top plan view, in part diagrammatic, of a portion of one form of a papermaking fabric layer illustrative of a preferred embodiment of the invention.
Figure 11:
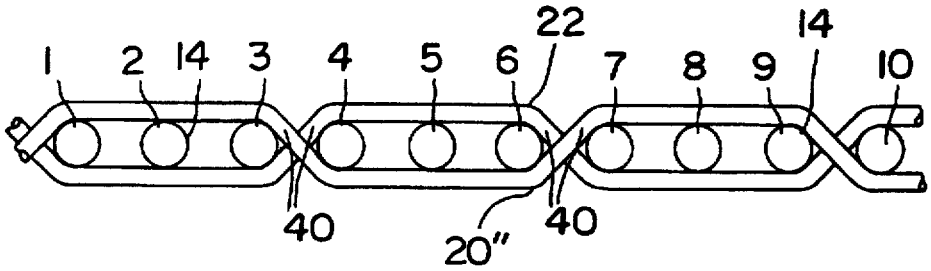
FIG. 11 is a sectional view taken along line XI—XI of FIG. 10.
Figure 12:
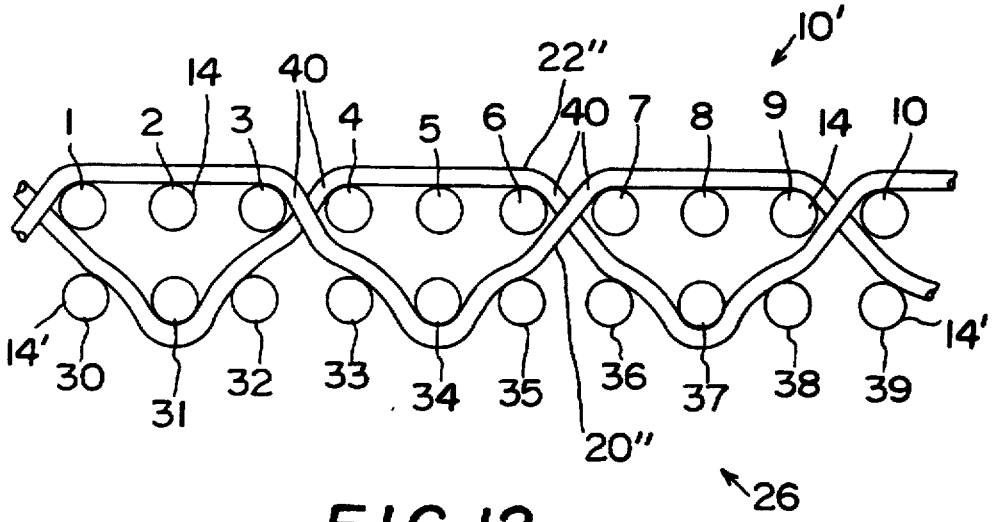
FIG. 12 is a sectional view similar to FIG. 11, but illustrative of another alternative embodiment of the invention.

A preferred second embodiment of the present invention is depicted in FIGS. 10–12. As in the first embodiment, the base fabric machine direction yarns 14 and cross machine direction yarns 12 are interwoven to provide single float knuckles 16 in both the machine direction and cross machine direction. In second embodiment, however, the first additional cross machine direction yarns 20" pass over a first odd number of adjacent machine direction fabric yarns 14 while the second additional cross machine direction yarns 22" pass under a second odd number of adjacent machine direction fabric yarns 14 which is greater than one in a repeating opposite weave pattern. In the preferred construction of FIGS. 10–12, the first and second odd numbers of adjacent machine direction fabric yarns (or float length) are both three.

With odd float lengths for the additional cross machine direction yarns, and in contrast to the embodiment of FIG. 5, the first 20" and second 22" additional cross machine direction yarns are interwoven with the fabric in such a way that both ends 40 of the floats are lifted by a single float machine direction yarn knuckle 16. Also, each additional cross machine direction yarn 20", 22" is located centrally between adjacent base fabric cross machine direction yarns 12 at both of its float ends 40 by the other additional cross machine direction yarn. This weave tends to provide improved drainage hole size uniformity and improved cross machine direction fiber support compared to the embodiment of FIG. 5.

In FIGS. 10–12, there is shown a preferred weave pattern for the additional yarns 20" and 22". As in the first embodiment, both additional yarns 20", 22" serve as fiber supporting yarns and both serve as locator yarns. For clarity and ease of comparison, the machine direction yarns 14 are designated 1–10 in FIGS. 10–12, and the machine direction yarns of an upper fabric layer 10' are similarly designated in FIG. 14. A second fabric layer 26 in FIG. 12 includes machine direction yarns 14' designated 30–39.

As illustrated in FIGS. 10 and 11, each of the first additional yarns 20" preferably extends over a float of three machine direction yarns 14, namely yarns numbered 1–3, under machine direction yarn numbers 4–6, over another float of three yarns, numbered 7–9, and under three yarns, etc. Second additional yarn 22" extends under the machine direction yarns numbered 1–3, over a float of three yarns numbered 4–6, under yarn three machine direction yarns 7–9, and over three yarns, etc. Thus, with respect to machine direction yarns 1–3, and 7–9 the additional first yarns 20" serve as fiber supporting yarns. Similarly, with respect to machine direction yarns 4–6, and 10 the additional second yarns 22" serve as fiber supporting yarns. At the cross-over points, or float "ends" 40 of the first and second additional first and second cross machine direction yarns, as for example, between machine direction yarns 3 and 4, 6 and 7, and 9 and 10, the first and second additional yarns each act as a locator yarn for the other.

Referring to FIG. 12, wherein there is illustrated a preferred weave pattern in a triple-layer embodiment, it will be seen that the first additional yarn 20" passes over a float of three machine direction yarns numbered 1–3, beneath machine direction yarns numbered 4–6, and beneath machine direction yarn 34 in the fabric layer 26. Additional yarn 20" emerges from beneath the top surface between machine direction yarns numbered 6 and 7, of the fabric layer 10'. Yarn 20" extends beneath the top surface and into the base fabric layer between machine direction yarns numbered 9 and 10, of the fabric layer 10'.

The second additional yarn 22" follows a similar course, in an opposite weave pattern from that of the first yarn 20". Yarn 22" passes under machine direction yarn number 31 of the second fabric layer 26, passes between machine direction yarns numbered 3 and 4, over a float of three yarns numbered 4–6, beneath machine direction yarns numbered 7–9, and further beneath machine direction yarn 34 in the fabric layer 26. Additional yarn 22" emerges from beneath the top surface between machine direction yarns numbered 9 and 10, of the fabric layer 10'. Thus, in the as in the embodiment shown in FIG. 9, in FIG. 12 each of the additional yarns 20", 22" serves three functions: (1) as a fiber supporting yarn, (2) as a locator yarn, and (3) as a binder of first and second fabric layers in a triple layer construction.

Figure 13:
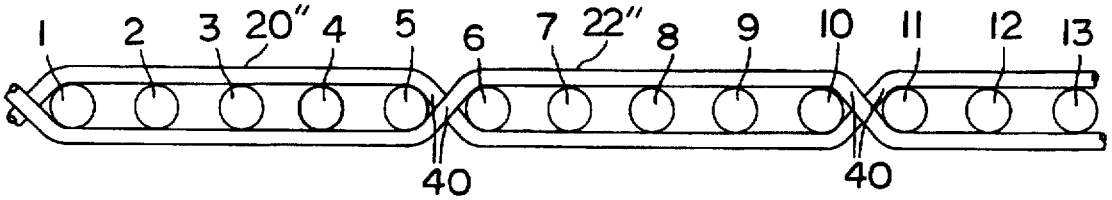
FIG. 13 is a sectional view similar to FIG. 11, but illustrative of yet another embodiment of the invention.
Figure 14:
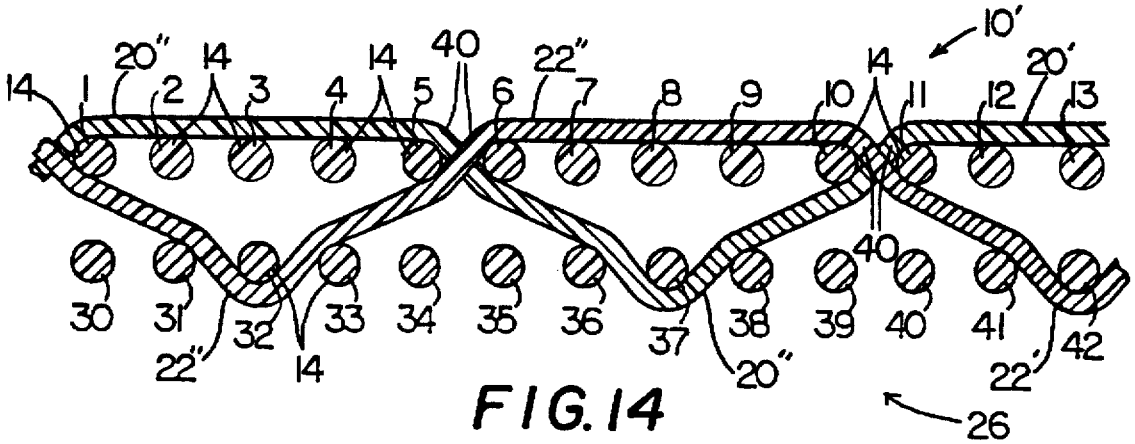
FIG. 14 is a sectional view similar to FIG. 8, but illustrative of another alternative embodiment of the invention.

As shown in FIG. 13, the additional cross machine direction yarns 20", 22" can also be woven to float over 5 adjacent machine direction base fabric yarns 14 which are numbered 1–13 in FIG. 13. A preferred weave pattern in a triple-layer five float embodiment is shown in FIG. 14 wherein the base fabric yarns 14' of a bottom fabric layer 26 are numbered 30–42 . Other longer odd number float lengths are also possible to achieve improved fiber retention at the expense of fabric stability and localized pairing of the additional and base fabric cross machine direction yarns. Nonetheless, a float length of three as in FIG. 12 is preferred in triple layer embodiments where the top base fabric layer cross machine direction yarn size is between 0.15 mm and 0.20 mm, the additional cross machine direction yarn size is between 0.09 mm and 0.17 mm, and the top layer end count is between 70 and 80 epi. A float length of three yarns provides good weave stability and minimizes the risk of fiber entanglement in papermaking.

Figure 15:
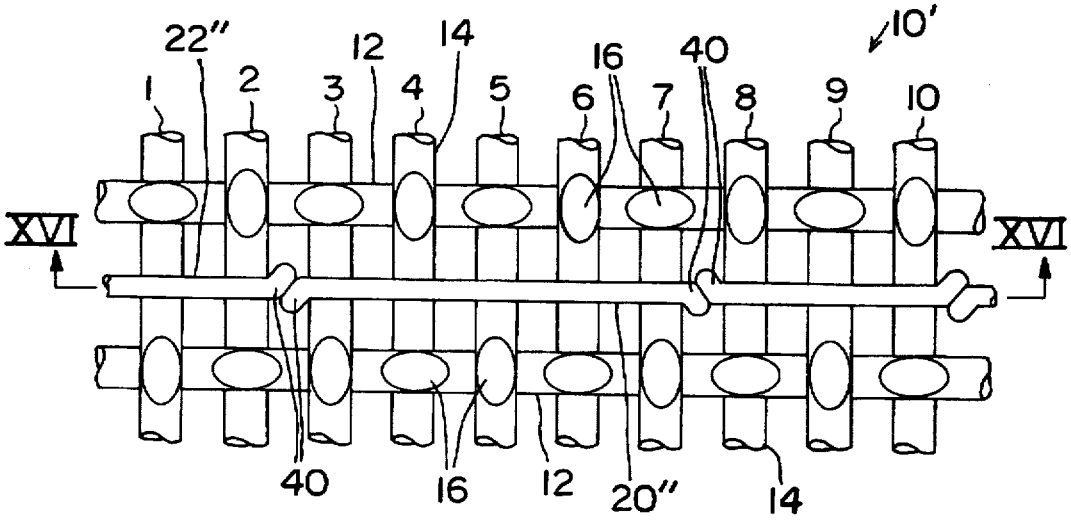
FIG. 15 is a top plan view, in part diagrammatic, of a portion of one form of a papermaking fabric layer illustrative of yet another embodiment of the invention.
Figure 16:
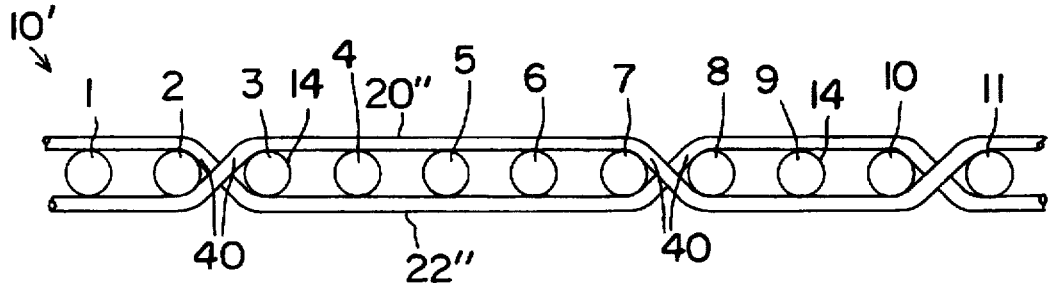
FIG. 16 is a sectional view taken along line XVI—XVI of FIG. 15.
Figure 17:
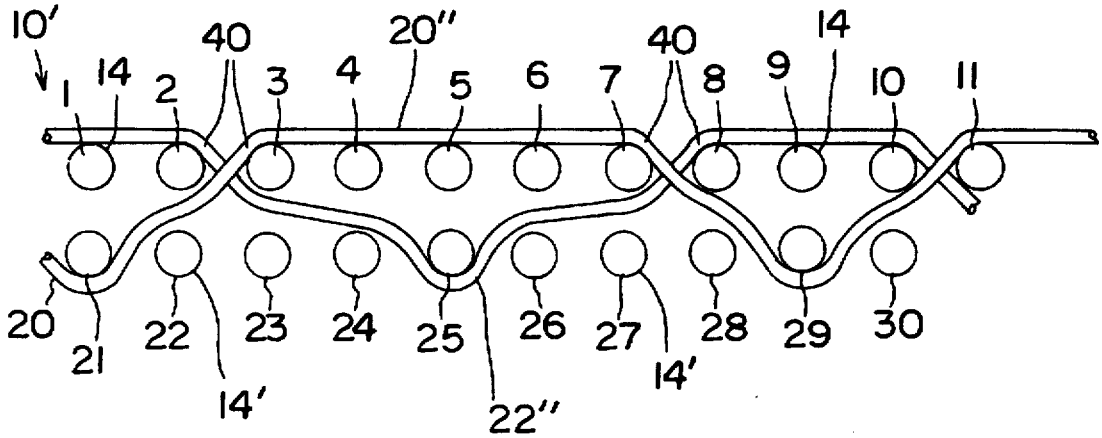
FIG. 17 is a sectional view similar to FIG. 16, but illustrative of another alternative embodiment of the invention.

With reference now to FIGS. 15–17, the additional cross machine direction yarns 20", 22" may also be woven in opposite weaves with different odd number float lengths. In FIGS. 15 and 16, for example, the first machine direction yarn 20" extends over a float of five adjacent machined direction base fabric yarns, i.e. yarns 3–7 before descending below the papermaking surface between yarns 7 and 8. The additional cross machine direction yarn 20" continues in the base fabric under a float of three adjacent base fabric machine direction yarns, i.e. yarns 8–10 and then extends back into the papermaking surface between yarns 10 and 11. The additional machine direction yarn 22" is woven in an opposite weave pattern from that of yarn 20" and extends under a float of five machine direction base fabric yarns, i.e. yarns 3–7 and then passes between yarns 7 and 8 to extend over a float of three machine direction fabric yarns, i.e. yarns 8–10. Thus, each of the additional cross machine direction yarns locate each other centrally between adjacent base fabric cross machine direction yarns, and each of the additional cross machine direction yarns act as fiber supporting yarns over different float lengths.

Referring to FIG. 17, wherein there is illustrated a preferred weave pattern in a triple-layer embodiment, it will be seen that the first additional yarn 20" passes over a float of five machine direction yarns numbered 3–7, beneath machine direction yarns numbered 8–10, and beneath machine direction yarn 29 in the fabric layer 26. Additional yarn 20" emerges from beneath the top surface between machine direction yarns 10 and 11, of the fabric layer 10'.

The second additional yarn 22" follows an opposite weave pattern from that of the first yarn 20". Yarn 22" passes beneath yarns 3–7 of the top fabric layer 10' and under machine direction yarn number 25 of the second fabric layer 26, passes between machine direction yarns numbered 7 and 8, over a float of three yarns numbered 8–10, and then back into the base fabric layer through yarns 10 and 11.

To form the weaves of FIGS. 10–17 a minimum number of harnesses is required which is equal to either an even multiple of the additional cross machine direction yarn float length when the float lengths of the first and second additional cross machine direction yarns are equal, or a multiple, greater than or equal to one, of the sum of float lengths of the first and second additional cross machine direction yarns when the float lengths are not equal. Thus, for example, in the embodiment of FIG. 11 a minimum of 6 harnesses would be required; while in the triple layer embodiment of FIG. 12, a minimum of 12 harnesses would be required. A minimum of 8 harnesses would be required for the fabric of FIG. 16; while 16 harnesses would be required for the fabric of FIG. 17.

In the triple layer embodiments of the present invention, several bottom weave constructions are possible. Depending on the bottom weave selected, however, machine side warp stitching frequency may vary, or stitching on certain additional cross machine direction yarns may not be possible. In addition, the relative position of the successive pairs of additional cross machine direction yarn floats will be limited by the available stitch locations. With any broken twill bottom weave, the additional cross machine direction yarn floats can follow the same broken twill. This, too, is beneficial to the papermaking process since any wire mark imparted to the paper will be twill free.

Figure 18:
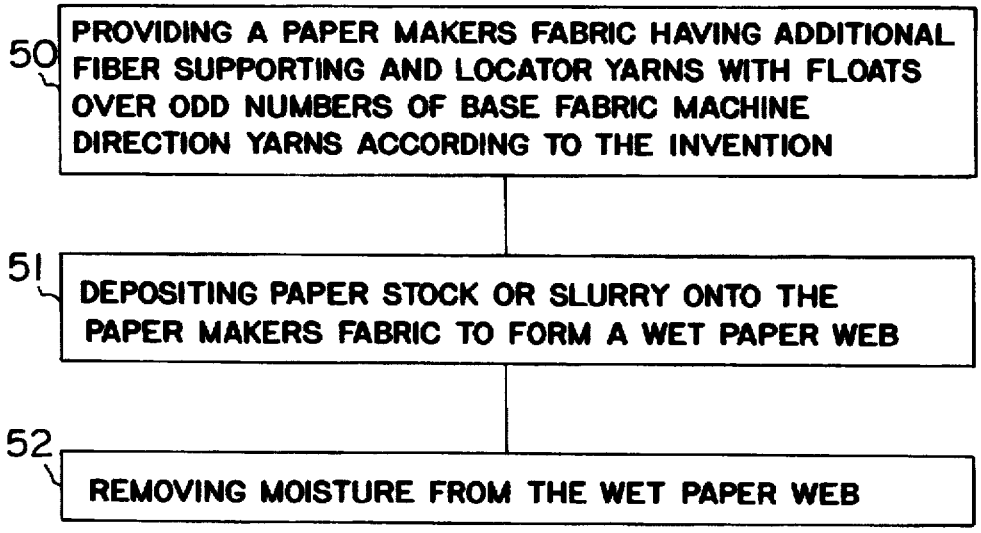
FIG. 18 is a block diagram of a process for producing paper using the papermakers' fabric described herein.

Referring to FIG. 18, a process for forming high quality paper using the papermaker's fabric as herein described is shown in block diagram form. The process includes providing a papermakers' fabric including fiber supporting and locator yarns according to the invention 50, and the conventional fourdrinier process steps (as described above) of depositing a slurry on the fabric 51, and removing the moisture from the slurry 52 in various stages. Advantageously, using the papermakers' fabric according to the present invention, and particularly a fabric as described above having additional cross machine direction yarns which float over odd numbers of adjacent base fabric machine direction yarns, in a conventional papermaking process results in the formation of a high quality paper with a smooth surface and excellent printability compared to the prior art.

There is thus provided a papermaker's fabric having a superior fiber supporting surface, while maintaining a durable wear resistant machine contacting side, a fabric in which a significant number of the paper fiber supporting yarns are fine relative to the fabric yarns, to provide quality support but preserve the openness required for drainage. There is further provided a fabric having a predominance of cross machine direction support floats on the papermaking surface, with no machine direction yarn knuckle being greater than a single float.

It is to be understood that the present invention is by no means limited to the particular constructions herein disclosed and/or shown in the drawings, but also comprises any modifications or equivalents within the scope of the claims.

Having thus described my invention, what I claim as new and desire to secure by Letters Patent of the United States is:

1. A process for forming paper comprising:

providing a papermakers forming fabric, said forming fabric comprising:

a base fabric layer including cross machine direction fabric yarns and machine direction fabric yarns interwoven to form a papermaking surface with alternating single knuckles in the machine direction and cross machine direction on said papermaking surface;

first additional cross machine direction yarns positioned between adjacent ones of said cross machine direction fabric yarns on said papermaking surface of said base fabric layer, said first additional cross machine direction yarns not forming part of said alternating knuckles of said base fabric layer; and second additional cross machine direction yarns positioned between said adjacent ones of said cross machine direction fabric yarns on said papermaking surface of said base fabric layer, said second additional cross machine direction yarns not forming part of said alternating knuckles of said base fabric layer;

wherein said first and second additional cross machine direction yarns are interwoven in opposite weaves with said base fabric layer, said first additional cross machine direction yarn passing over a first odd number of first adjacent machine direction fabric yarns and under a second odd number of the next adjacent machine direction fabric yarns, said second additional cross machine direction yarn passing under said first odd number of said first adjacent machine direction fabric yarns and over said second odd number of said next adjacent machine direction fabric yarns; and wherein said first additional cross machine direction yarn serves as a fiber supporting yarn while passing over said first odd number of adjacent machine direction fabric yarns and serves as a locator yarn for locating said second additional cross machine direction yarn in a substantially central position between said adjacent ones of said cross machine direction fabric yarns while passing under said second odd number of adjacent machine direction fabric yarns, and said second additional cross machine direction yarn serves as a locator yarn for locating said first additional cross machine direction yarn in a substantially central position between adjacent ones of said cross machine direction fabric yarns while passing under said first odd number of adjacent machine direction fabric yarns and serves as a fiber support yarn while passing over said next adjacent machine direction fabric yarns depositing paper stock on said papermakers' fabric to form a wet paper web; and removing moisture from said wet paper web.

2. The process in accordance with claim 1 including a plurality of pairs of said first and second additional cross machine direction yarns, wherein in each pair of first and second additional cross machine direction yarns, both of said first and second additional cross machine direction yarns serve to locate one another between said adjacent ones of said cross machine direction fabric yarns at points where said first and second additional cross machine direction yarns cross each other in entering or leaving said papermaking surface.

3. The process in accordance with claim 1 wherein said base fabric layer including cross machine direction fabric yarns and machine direction fabric yarns comprises a first fabric layer, and said forming fabric further comprises a second fabric layer, and each of said first and second additional cross machine direction yarns serve further as binding yarns joining said first fabric layer to said second fabric layer.

4. The process fabric in accordance with claim 1 wherein said base fabric layer comprises a first fabric layer, and a second fabric layer, and each of said first and second additional cross machine direction yarns serve further as binding yarns joining said first fabric layer to said second fabric layer.

5. A process for forming paper, comprising:

a papermakers forming fabric comprising:

a base fabric layer including cross machine direction fabric yarns and machine direction fabric yarns interwoven to form a papermaking surface with alternating single knuckles in the machine direction and cross machine direction on said papermaking surface;

first additional cross machine direction yarns positioned between adjacent ones of said cross machine direction fabric yarns on said papermaking surface of said base fabric layer, said first additional cross machine direction yarns not forming part of said alternating knuckles of said base fabric layer; and second additional cross machine direction yarns positioned between said adjacent ones of said cross machine direction fabric yarns on said papermaking surface of said base fabric layer, said second additional cross machine direction yarns not forming part of said alternating knuckles of said base fabric layer;

wherein said first and second additional cross machine direction yarns are interwoven with said base fabric layer such that each of said first additional cross machine direction yarns passes under a first set of an odd number of adjacent machine direction fabric yarns, and each of said second additional cross machine direction yarns passes under a second set of an odd number of machine direction fabric yarns, wherein each of said first additional cross machine direction yarns serves as a fiber supporting yarn while passing over some of said second set of adjacent machine direction fabric yarns and serves as a locator yarn for locating said second additional cross machine direction yarn in a substantially central position between said adjacent ones of said cross machine direction fabric yarns while passing under said first set of adjacent machine direction fabric yarns, and said second additional cross machine direction yarn serves as a locator yarn for locating said first additional cross machine direction yarn in a substantially central position between said adjacent ones of said cross machine direction fabric yarns while passing under said first set of adjacent machine direction fabric yarns and serves as a fiber support yarn while passing over some of said second set of adjacent machine direction fabric yarns.

6. The process in accordance with claim 5 wherein each of said first and second additional cross machine direction yarns crosses the other of said first and second additional cross machine direction yarns at crossing points, and wherein said crossing points are located between said first and second sets of adjacent machine direction fabric yarns in entering and leaving said papermaking surface.

7. The process in accordance with claim 5 wherein said base fabric layer including cross machine direction fabric yarns and machine direction fabric yarns comprises a first fabric layer, and said forming fabric further comprises a second fabric layer, and each of said first and second additional cross machine direction yarns serve further as binding yarns joining said first fabric layer to said second fabric layer.

8. The process in accordance with claim 5 wherein said first additional cross machine direction yarn passes below one of said first set of adjacent cross machine direction fabric yarns, and said second additional cross machine direction yarn passes below one of said second set of adjacent cross machine direction fabric yarns.

* * * * *